US005711359A

United States Patent [19]

Simon et al.

[11] Patent Number: 5,711,359

[45] Date of Patent: *Jan. 27, 1998

[54] VENETIAN BLIND HAVING REPLACEABLE LADDER CORD COVERS

[75] Inventors: Terry Simon, West Olive, Mich.; Merrill Gitkin, Franklin Lakes, N.J.

[73] Assignee: Jencraft Corporation, Totowa, N.J.

[ * ] Notice: The term of this patent shall not extend beyond the expiration date of Pat. No. 5,597,027.

[21] Appl. No.: 385,321

[22] Filed: Feb. 8, 1995

[51] Int. Cl.[6] ..... E06B 9/30

[52] U.S. Cl. ..... 160/168.1 R; 160/178.3 R

[58] Field of Search ..... 160/176.1 R, 178.3 R, 160/177 R, 168.1 R, 170 R, 178.1 R, 173 R

[56] References Cited

U.S. PATENT DOCUMENTS

| | | | |
|---|---|---|---|
| 2,105,937 | 1/1938 | White et al. | 160/178.3 |
| 2,251,363 | 8/1941 | McGrew | 160/178.3 X |
| 2,290,634 | 7/1942 | Clark, Jr. | 160/178.3 |
| 2,527,104 | 10/1950 | Schaefer . | |
| 2,529,229 | 11/1950 | Sherwood | 160/168.1 R |
| 2,537,865 | 1/1951 | Stuber et al. . | |
| 2,796,927 | 6/1957 | Evans . | |
| 3,086,586 | 4/1963 | Wolfe . | |
| 3,265,117 | 8/1966 | Lorentzen et al. . | |
| 3,332,471 | 7/1967 | Croxen . | |
| 4,515,201 | 5/1985 | Anderson . | |
| 4,722,382 | 2/1988 | Vecchiarelli | 160/178.1 R |
| 5,597,027 | 1/1997 | Simon | 160/178.3 R X |

*Primary Examiner*—Blair Johnson

*Attorney, Agent, or Firm*—Lerner, David, Littenberg, Krumholz & Mentlik

[57] ABSTRACT

A venetian blind includes replaceable ladder cord covers. The ladder cord covers may be constructed in a variety of widths to achieve an appropriate ornamental appearance, as well as being provided with decorative surfaces having a variety of motifs. The ladder cord covers may be color coordinated with the venetian blind to enhance its aesthetic appeal. The ladder cord covers are formed as elongated strips which are removably attachable by the user to the ladder cords when and as desired.

22 Claims, 4 Drawing Sheets

VENETIAN BLIND HAVING REPLACEABLE LADDER CORD COVERS

BACKGROUND OF THE INVENTION

The present invention relates in general to window treatments of the venetian blind type, and more particularly, to replaceable ladder cord covers which enable the free alteration of the ornamental appearance of the venetian blind by covering the ladder cords with covers of different decorative designs and/or widths.

Venetian blinds are available in a plurality of shapes and sizes. In all cases, the venetian blind is constructed from a headrail which supports the operating assembly and a plurality of tiltable slats supported from the headrail by at least a pair of spaced apart ladder cords. The ladder cords are connected to a tilting mechanism within the headrail to enable the tilting of the slats to effect light control.

The ladder cords are available in a plurality of widths to provide different looks to the venetian blind. For example, the ladder cords may be in the nature of a single cord, or a wide flat tape ranging anywhere from one quarter to two inches in width. The particular width of the ladder cord must be specified at the time of purchase. Thereafter, the user can no longer alter the appearance of the venetian blind with a ladder cord of different width, without having to purchase an entire new venetian blind. It is therefore desirable to provide the consumer with the ability to alter the appearance of the venetian blind by changing the ladder cords to ones of different widths or those having decorative appearance.

SUMMARY OF THE INVENTION

It is one object of the present invention to provide a venetian blind which enables the user to alter the appearance of the venetian blind through the application of replaceable ladder cord covers.

Another object of the present invention is to provide a replaceable ladder cord cover having different widths and/or decorative appearance.

Another object of the present invention is to provide a replaceable ladder cord cover which is easy to install and remove by the user as desired.

In accordance with one embodiment of the present invention there is provided a blind comprising a headrail, support means extending from the headrail for supporting a plurality of slats, and cover means removably attachable to the support means for concealing a portion thereof, whereby the cover means may be removed and replaced with another one of the cover means.

In accordance with another embodiment of the present invention there is provided a blind comprising a headrail, at least a pair of spaced apart ladder cords extending from the headrail supporting a plurality of slats, each of the ladder cords including at least one elongated vertical member extending along a common side of the blind, and at least a pair of elongated strips removably attachably to a corresponding one of the vertical members, whereby the elongated strips may be removed and replaced with another one of the strips.

In accordance with another embodiment of the present invention there is provided a member removably attachable to the ladder cord of a blind, the member comprising an elongated strip, and at least one fastener for removably attaching the member to the ladder cord, whereby the strip may be removed and replaced with another one of the strips.

In accordance with another embodiment of the present invention there is provided a ladder cord cover removably attachable to the ladder cord of a venetian blind, the cover comprising an elongated flat strip, a plurality of fasteners attached to the strip at spaced apart locations on one common side thereof, the fasteners removably securing the strip to the ladder cord, whereby the strip can be replaced with another one of the strips.

BRIEF DESCRIPTION OF THE DRAWINGS

The above description, as well as further objects, features and advantages of the present invention will be more fully understood with reference to the following detailed description of a venetian blind having replaceable ladder cord covers, when taken in conjunction with the accompanying drawings, wherein.

DETAILED DESCRIPTION OF THE PREFERRED EMBODIMENTS

Figure 1:
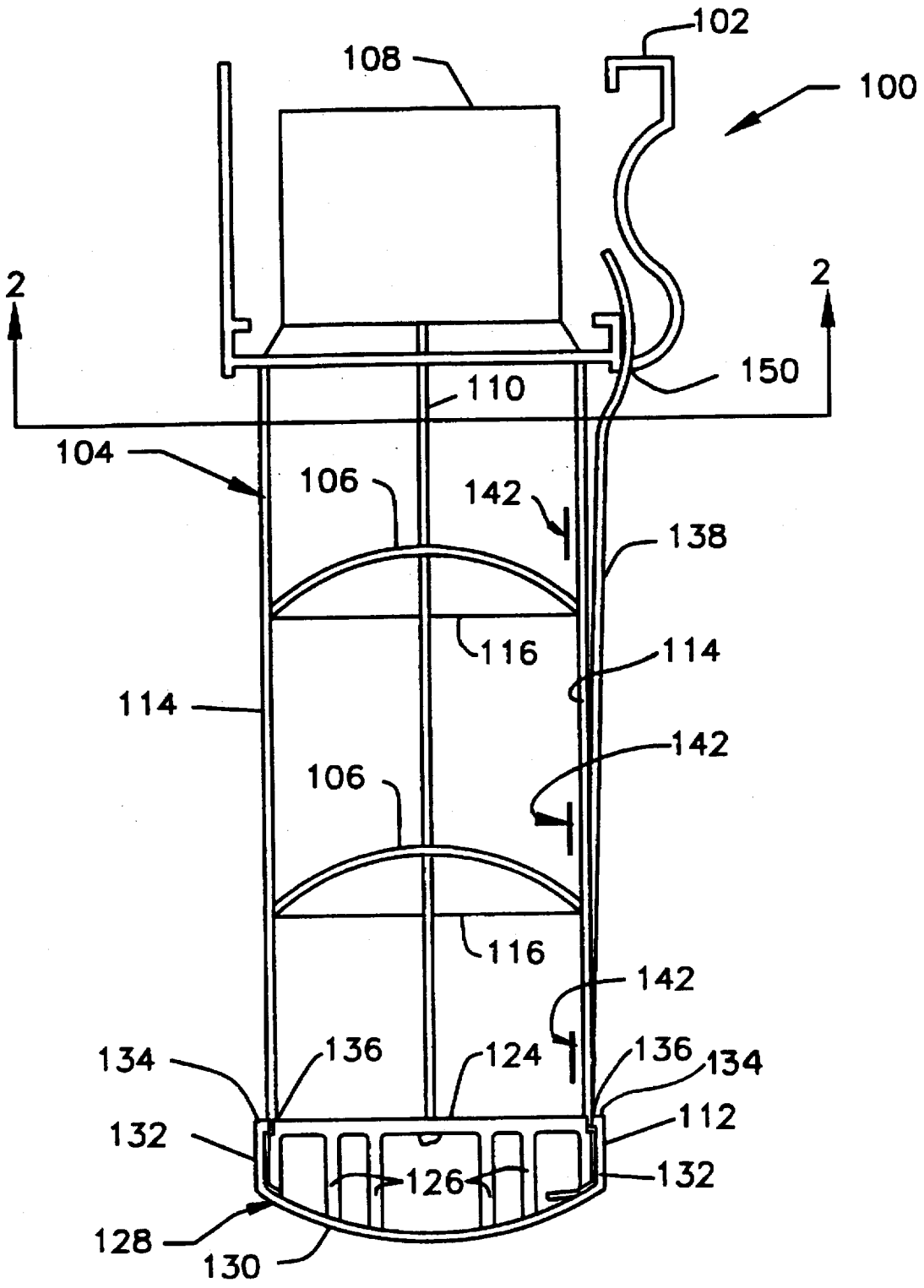
FIG. 1 is a side elevational view of a venetian blind constructed in accordance with one embodiment of the present invention.

Referring now to the drawings, wherein like reference numerals represent like elements, there is shown in FIG. 1 a venetian blind constructed in accordance with one embodiment of the present invention and designated generally by reference numeral 100. The venetian blind 100 is constructed from an elongated headrail 102 from which there is suspended one or more spaced apart ladder cords 104 for supporting a plurality of slats 106. An operating assembly 108 is positioned within the headrail 102 for adjusting the orientation of the slats 106, as well as raising and lowering the slats by means of a lift cord 110. The lower ends of the ladder cords 104 and lift cord 110 are attached to a bottom rail 112. The operating assembly 108 may be constructed in a variety of forms, for example, see U.S. application Ser. No. 08/350,316 entitled "Low Profile Venetian Blind", filed on Dec. 2, 1994 and assigned to the same Assignee of the present application.

The ladder cords 104 are constructed from a pair of spaced apart elongated members 114 horizontally interconnected by a plurality of equally spaced apart support members 116. The support members 116 are operative for supporting a respective slat 106 which includes aligned openings (not shown) through which there is threadably received the lift cord 110. Although the members 114 of the ladder cords 104 may be constructed as cord-like members, they may also be constructed as flat tapes of varying width.

Figure 2:
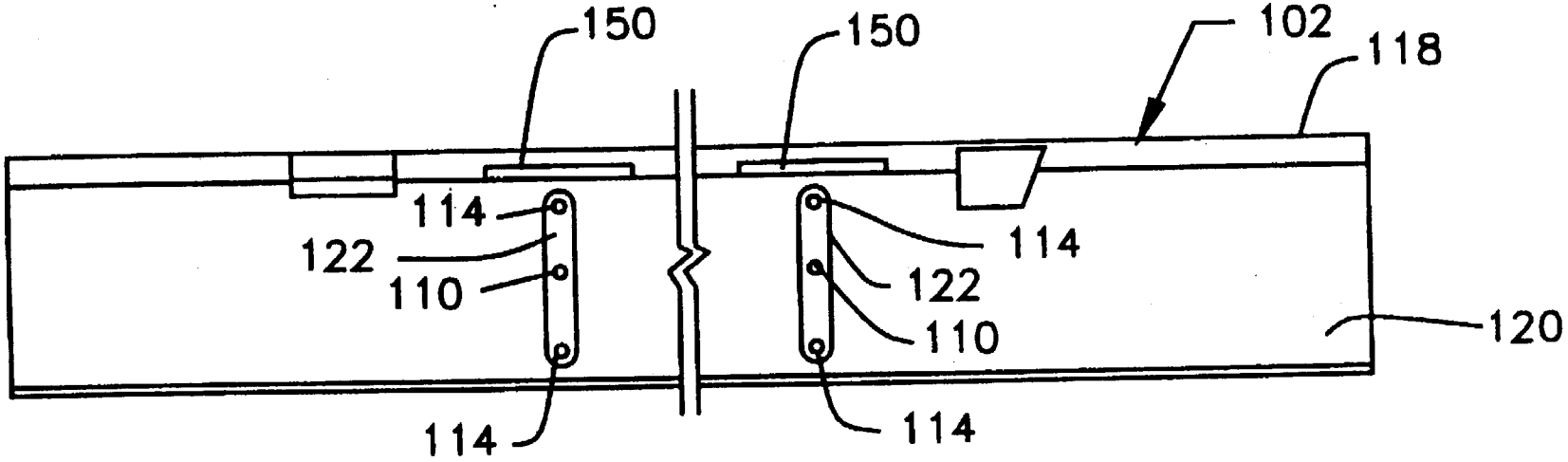
FIG. 2 is a bottom plan view of a venetian blind headrail adapted for accommodating replaceable ladder cord covers.

As shown in FIG. 2, the headrail 102 is constructed from an elongated body 118 having a bottom wall 120 provided with two spaced apart slots 122 arranged transverse to the longitudinal axis of the headrail. The slots 122 are arranged in alignment with the location of the ladder cords 104. In this regard, the free ends of the ladder cords 104, i.e., the members 114, as well as the lift cord 110, extend through their respectively aligned slot 122 for connection to the operating assembly 108. The other free ends of the ladder cords and lift cords 110 are attached to the bottom rail 112.

The bottom rail 112 is constructed from an elongated planar member 124 from which there downwardly depends a plurality of spaced apart ribs 126 having a curved outer profile. An elongated cover 128 is adapted to be releasably secured over the ribs 126. In this regard, the cover 128 is provided with a curved bottom wall 130 having the same radius as the outer ends of the ribs 126. A pair of spaced apart sidewalls 132 extend upwardly from the bottom wall 130 and are provided with inwardly turned flanges 134. The flanges 134 are adapted to be captured within notches 136 extending along the sides of the planar member 124. Accordingly, the free ends of the ladder cords 104 are secured to the bottom rail by being captured about the outermost ribs 126 by means of the sidewalls 132 of the cover 128 when secured thereon by the flanges 134 being received within the notches 136. The lift cord 110, on the other hand, is threadably received through an opening (not shown) within the planar member 124 and formed with a knot or other suitable means for securing the lift cord thereat.

Figure 3:
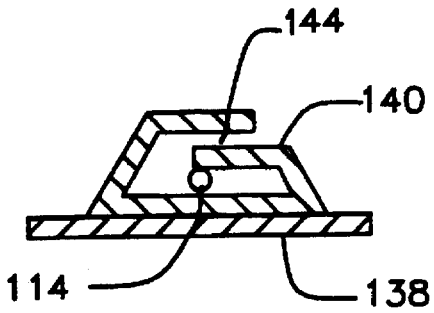
FIG. 3 is a top plan view of a replaceable ladder cord cover removably attached to a ladder cord in accordance with one embodiment of the present invention.
Figure 6:
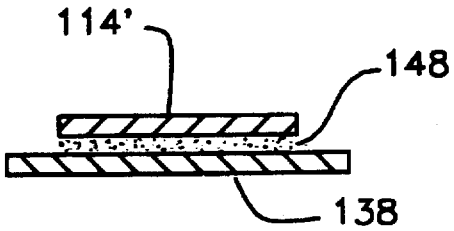
FIG. 6 is a top plan view of a replaceable ladder cord cover removably attached to a ladder cord in accordance with another embodiment of the present invention.

Referring now to FIGS. 1 and 3–6, various embodiments of a replaceable ladder cord cover will now be described. As shown in FIGS. 1 and 3, the ladder cord cover 138 is constructed as an elongated flat tape extending from within the bottom rail 112 to within the headrail 102. The ladder cord cover 138 can be constructed from a variety of widths to provide the venetian blind 100 with a different ornamental appearance as may be desired by the user. For example, the width of the ladder cord cover 138 may range from one quarter of an inch to two inches or more as may be desired for a particular effect. The ladder cord cover 138 may be constructed from a variety of materials having suitable texture and color to complement the venetian blind 100. For example, the ladder cord cover 138 may be a solid color in the same or contrasting with that of the slats 116. In addition, the ladder cord cover 138 may have a variety of smooth or textured surfaces, weaves and the like to provide a specific ornamental appearance. In addition, the surface of the ladder cord cover 140, as shown in FIG. 6, may be decorated with an infinite number of patterns and/or motifs. As shown, the outer surface 142 is provided with a decorative geometric pattern. However, it is possible to have various motifs such as holidays, seasons, or the like.

Figure 4:
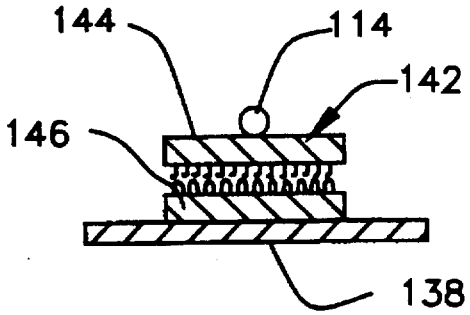
FIG. 4 is a top plan view of a replaceable ladder cord cover removably attached to a ladder cord in accordance with another embodiment of the present invention.

The ladder cord cover 138 can be attached to the ladder cords 104 in a variety of manners. For example, as shown in FIG. 3, the ladder cord cover 138 may be provided with a plurality of hooks 140 spaced apart along the longitudinal length thereof. In this regard, each of the hooks 140 is provided with a restricted opening 144 to enable passage of the members 114 of the ladder cords 104 therethrough. As shown in FIG. 4, the ladder cord cover 138 may be attached to the members 114 by means of a Velcro fastener 142. The Velcro fastener 142 is constructed from a male hook member 144 and a female loop member 146. In the embodiment disclosed, the female loop member 146 is attached at spaced apart locations along the longitudinal length of the ladder cord cover 138 facing the ladder cords 104. At corresponding opposing locations, a male hook member 144 is attached to the members 114 of the ladder cords 104. In this manner, the mating of the male hook member 144 with the female loop member 146 will removably attach the ladder cord cover 138 to the ladder cord 104. It is to be understood that in another embodiment, the male hook member 144 may be attached to the ladder cord cover 138, and the female loop member 146 to the ladder cords 104.

Figure 5:
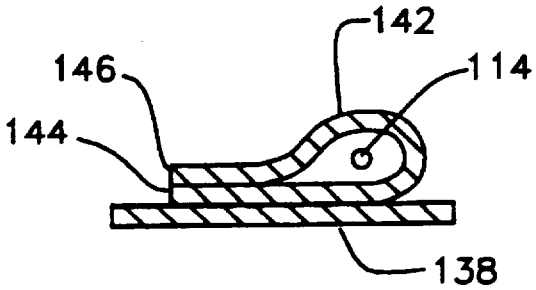
FIG. 5 is a top plan view of a replaceable ladder cord cover removably attached to a ladder cord in accordance with another embodiment of the present invention.
Figure 7:
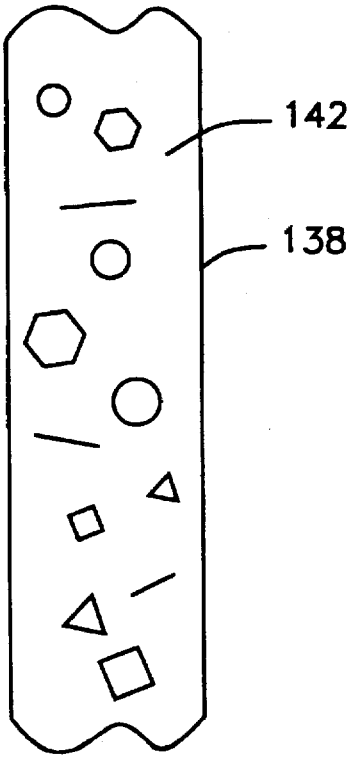
FIG. 7 is a front elevational view of a replaceable ladder cord cover having a decorative surface in accordance with one embodiment of the present invention.

As shown in FIG. 5, the Velcro fastener 142 may be constructed as a single elongated member which is releasably attachable to itself. In this regard, one portion of the Velcro fastener will be formed as a male hook member 144, and its opposing portion as a female loop member 146. This arrangement eliminates the necessity of having to secure one of the members 144, 146 to the ladder cords 104. In accordance with another embodiment as shown in FIG. 6, the ladder cord cover 138 may be removably attached to the ladder cord 104 by means of a releasable adhesive 148 disposed therebetween. The releasable adhesive 148 may take the form of adhesive tapes, as well as suitable gelled adhesives which have sufficient tack to adhere, yet enable removal as desired. As shown in FIG. 6, the ladder cord 104 may, in itself, be constructed from a relatively wide elongated member.

Referring once again to FIG. 1, the free ends of the ladder cord cover 138 are secured to the bottom rail in a similar manner as the free ends of the ladder cord 104. In this regard, the ladder cord cover 138 has its free end captured between the outer most rib 126 of the bottom rail 112 and the sidewall 132 of the cover 128. The other free end of the ladder cord cover 138 extends upwardly (see FIG. 2) through an aligned elongated slot 158 within the bottom wall 120 of the headrail 102 thereby hiding the free end. By means of this arrangement, the operation of the venetian blind 100 will not be interfered with by the presence of the ladder cord cover 138. In addition, the ladder cord cover 138 will appear to have been originally installed on the venetian blind 100 to retain the high quality look of the venetian blind.

Figure 8:
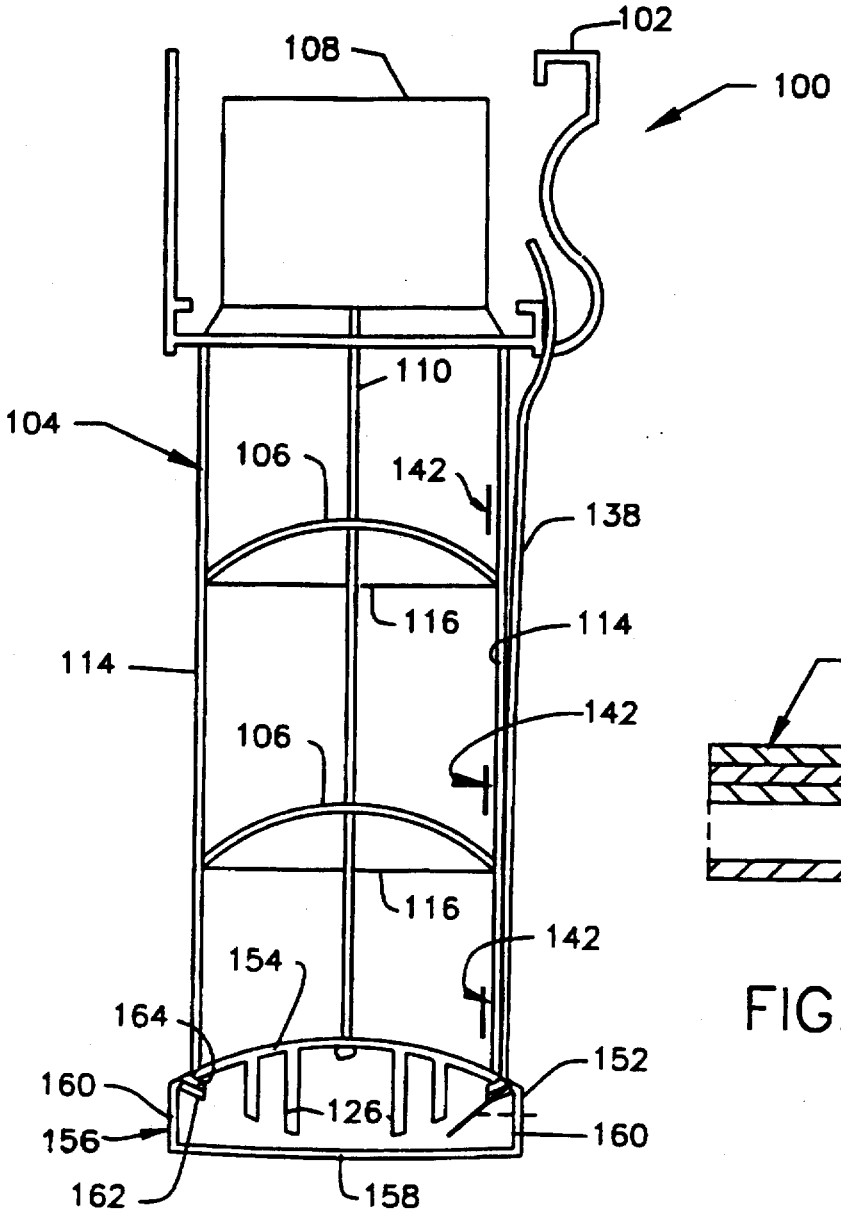
FIG. 8 is a side elevational view of a venetian blind constructed in accordance with another embodiment of the present invention having replaceable ladder cord covers.

Referring now to FIG. 8, there is shown another embodiment of a bottom rail 152 in accordance with the present invention. The bottom rail 152 has a reverse profile from the bottom rail 112 as shown in FIG. 1. In this regard, the planar member 154 has a curved profile while the cover 156 has a generally flat bottom wall 158. The sidewalls 160 of the cover 156 have inwardly and downwardly directed flanges 162 to be captured within longitudinally extending corresponding grooves 164 adjacent the lateral edges of the planar member 154. The releasable attachment of the cover 156 to the planar member 154 is operative for attaching both the free ends of the ladder cord 104 and ladder cord cover 138 thereto.

Figure 9:
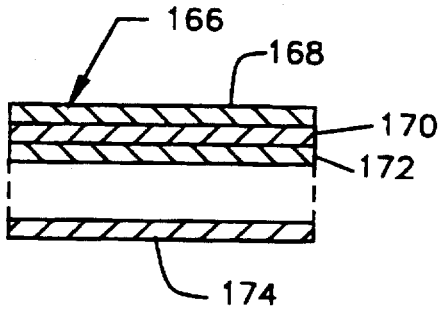
FIG. 9 is a top plan view of a replaceable ladder cord cover removably attached to a ladder cord in accordance with another embodiment of the present invention.

Referring now to FIG. 9, there is disclosed still another embodiment of the present invention. As shown, a ladder cord cover 166 is constructed from a flat elongated strip 168 which can be constructed from a variety of materials, such as paper, plastic, cloth and the like. One surface of the strip 168 is coated with an adhesive layer 170. The exposed surface of the adhesive layer 170 is covered with a release layer 172. The release layer 172 is of the conventional type which enables removal thereof to expose the surface of the adhesive layer 170. Upon removal of the release layer 172, a decorative material 174 may be applied to the strip 168 by the user. In this regard, the decorative material 174 may comprise wallpaper, wrapping paper or any other material desired. Accordingly, the ladder cord cover 166 may be personalized by the user by coordinating with a particular wallpaper, border or the like.

Although the invention herein has been described with reference to particular embodiments, it is to be understood that the embodiments are merely illustrative of the principles and application of the present invention. It is therefore to be understood that numerous modifications may be made to the embodiments and that other arrangements may be devised without departing from the spirit and scope of the present invention as defined by the claims.

What is claimed is:

1. A blind comprising a headrail having an opening, support means extending from said headrail for supporting a plurality of slats, and cover means removably attachable to said support means for concealing a portion thereof, said cover means comprising an elongated strip including at least one fastener attaching said strip to said support means, said strip having a portion extendable into said headrail through said opening to conceal the end thereof, said portion comprising a loose end extending into said headrail and being unattached, whereby said strip may be removed and replaced with another one of said strips.

2. The blind of claim 1, wherein said strip has a width greater than the width of said support means.

3. The blind of claim 1, wherein said strip has a decorative exposed surface.

4. The blind of claim 1, wherein said fastener includes a plurality of hooks.

5. The blind of claim 1, wherein said fastener includes a release member engagable with a counterpart member on said support means.

6. The blind of claim 1, wherein said fastener includes adhesive.

7. The blind of claim 1 further including a bottom rail, said bottom rail comprising an elongated first member and a cover releasably engaging a portion of said first member, said strip having a portion captured between said first member and said cover for securing said portion thereat.

8. The blind of claim 1, further including another one of said strips wherein said another one of said strips is different from the replaced strip in surface decoration.

9. The blind of claim 1, further including another one of said strip wherein said another one of said strips is different from the replaced strip in width.

10. A blind comprising a headrail having an opening, a bottom rail spaced from said headrail, at least a pair of spaced apart ladder cords extending from said headrail to said bottom rail supporting a plurality of slats, each of said ladder cords including at least one elongated vertical cord-like member extending overlying a common side of said blind, at least a pair of elongated strips extending from said headrail removably attachably to a corresponding one of said vertical cord-like members overlying said common side of said blind, said strips having a continuous uninterrupted appearance from said headrail to said bottom rail, and at least one fastener positioned on each of said strips for removably attaching said strip to said cord-like members, said strips having a portion extending into said headrail through said opening to conceal the end thereof, said portion comprising a loose end extending into said headrail and being unattached, whereby said elongated strips may be removed and replaced with another one of said strips.

11. The blind of claim 10, further including a plurality of said fasteners positioned on each of said strips at spaced apart locations therealong.

12. The blind of claim 10, wherein said strip has a width substantially greater than the width of said vertical cord-like members.

13. The blind of claim 10, wherein said strip has a decorative exposed surface.

14. The blind of claim 10, wherein said fastener includes a plurality of hooks.

15. The blind of claim 10, wherein said fastener includes adhesive.

16. The blind of claim 10, wherein said fastener includes a release member engagable with a counterpart member on said vertical cord-like members.

17. The blind of claim 10, wherein said bottom rail comprising an elongated first member and a cover releasably engaging a portion of said first member, said strip having a portion captured between said first member and said cover for securing said portion thereat.

18. The blind of claim 10, further including another one of said strips wherein said another one of said strips is different from the replaced strip in surface decoration.

19. The blind of claim 10, further including another one of said strips wherein said another one of said strips is different from the replaced strip in width.

20. A blind comprising a headrail having an opening, support means extending from said headrail for supporting a plurality of slats, and cover means removably attachable to said blind for concealing a portion of said support means, said cover means comprising an elongated strip, said strip including at least one fastener for removably attaching said strip to said blind, said strip having a portion extendable into said headrail through said opening to conceal the end thereof, said portion comprising a loose end extending into said headrail and being unattached, whereby said strip may be removed and replaced with another one of said strips.

21. A blind comprising a headrail having an opening, at least a pair of spaced apart ladder cords extending from said headrail supporting a plurality of slats, each of said ladder cords including at least one elongated vertical member extending along said blind, and at least a pair of elongated strips removably attachable to a corresponding one of said vertical members, said strips having a portion extendable into said headrail through said openings to conceal the end thereof, said portion comprising a loose end extending into said headrail and being unattached, whereby said elongated strips may be removed and replaced with another one of said strips.

22. A blind comprising an elongated headrail having an opening, an elongated bottom rail spaced from said headrail, a pair of spaced apart ladder cords extending from said headrail having one end attached to said bottom rail, a plurality of tiltable slats supported by said ladder cords between said headrail and said bottom rail, each of said ladder cords including an elongated vertical cord-like member extending overlying a common side of said blind, a lift cord extending from said headrail having one end attached to said bottom rail, an operating assembly within said headrail for adjusting the orientation of said slats by means of said ladder cords and for raising and lowering said slats by means of said lift cord, a pair of elongated strips having a plurality of fasteners provided thereon in spaced apart relationship, each of said fasteners operative for removably attaching one of said strips to a corresponding one of said cord-like members overlying said common side of said blind, each of said fasteners including an opening for releasably receiving a portion of said cord-like member therein, one end of said strip removably attached to said bottom rail and the other end of said strip extending through said openings and terminating as a loose end unattached at a location within said headrail whereby there is provided a continuous uninterrupted appearance of said strips from said headrail to said bottom rail by concealing the end of said strip within said headrail.

* * * * *

UNITED STATES PATENT AND TRADEMARK OFFICE
CERTIFICATE OF CORRECTION

PATENT NO. : 5,711,359

DATED : January 27, 1998

INVENTOR(S) : Simon et al.

It is certified that error appears in the above-identified patent and that said Letters Patent is hereby corrected as shown below:

Column 5, line 45, "strip" should read --strips--.

Column 7, line 1, "openings" should read --opening--.

Signed and Sealed this

Twenty-eighth Day of April, 1998

Bruce Lehman

*Attest:*

BRUCE LEHMAN

*Attesting Officer*

*Commissioner of Patents and Trademarks*